US010914257B2

(12) United States Patent
Knopp et al.

(10) Patent No.: US 10,914,257 B2
(45) Date of Patent: Feb. 9, 2021

(54) METHOD AND CONTROL UNIT FOR REGULATING A FILL LEVEL OF A RESERVOIR OF A CATALYTIC CONVERTER FOR AN EXHAUST GAS COMPONENT IN COASTING MODE

(71) Applicant: Robert Bosch GmbH, Stuttgart (DE)

(72) Inventors: Martin Knopp, Markgroeningen (DE); Alexandre Wagner, Stuttgart (DE); Michael Fey, Wiernsheim (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 16/597,034

(22) Filed: Oct. 9, 2019

(65) Prior Publication Data

US 2020/0116095 A1 Apr. 16, 2020

(30) Foreign Application Priority Data

Oct. 10, 2018 (DE) ..... 10 2018 217 307

(51) Int. Cl.
*F02D 41/02* (2006.01)
*F02D 41/14* (2006.01)

(52) U.S. Cl.
CPC ..... *F02D 41/0295* (2013.01); *F02D 41/1446* (2013.01); *F02D 41/1455* (2013.01); *F02D 2200/0814* (2013.01)

(58) Field of Classification Search
CPC ..... F02D 41/0002; F02D 41/0295; F02D 41/123; F02D 41/1445; F02D 41/1446; F02D 41/1454; F02D 41/1455; F02D 41/1475; F02D 41/30; F02D 2041/1433; F02D 2200/0802; F02D 2200/0814; F02D 41/1441
See application file for complete search history.

(56) References Cited

FOREIGN PATENT DOCUMENTS

DE 102016222108 A1 5/2018
WO WO-2018071030 A1 * 4/2018 ..... F01N 3/10

* cited by examiner

*Primary Examiner* — Brandon D Lee
(74) *Attorney, Agent, or Firm* — Norton Rose Fulbright US LLP; Gerard Messina

(57) ABSTRACT

A method for regulating a filling of an exhaust gas component reservoir of a catalytic converter in the exhaust of an internal combustion engine. An actual fill level of the exhaust gas component reservoir is ascertained using a first system model, and in which a baseline lambda setpoint for a first control loop is predefined by a second control loop in which an initial value for the baseline lambda setpoint is converted, by a second system model identical to the first system model, into a fictitious fill level; the fictitious fill level is compared with a setpoint for the fill level; and the baseline lambda setpoint is iteratively modified as a function of the comparison result. At the beginning of a coasting phase, the baseline lambda setpoint is calculated based on signals of sensors and control variables which relate to the delivery of air and/or fuel to combustion chambers.

13 Claims, 7 Drawing Sheets

METHOD AND CONTROL UNIT FOR REGULATING A FILL LEVEL OF A RESERVOIR OF A CATALYTIC CONVERTER FOR AN EXHAUST GAS COMPONENT IN COASTING MODE

CROSS REFERENCE

The present application claims the benefit under 35 U.S.C. § 119 of German Patent Application No. DE 102018217307.9 filed on Oct. 10, 2018, which is expressly incorporated herein by reference in its entirety.

FIELD

The present invention relates to a method for regulating a filling of an exhaust gas component reservoir of a catalytic converter in the exhaust of an internal combustion engine. In its apparatus-related aspects, the present invention relates to a control unit.

BACKGROUND INFORMATION

A method and a control unit are described in German Patent Application No. DE 10 2016 222 108 A1. With the conventional method and control unit, regulation of a filling of an exhaust gas component reservoir of a catalytic converter in the exhaust of an internal combustion engine occurs, in which method an actual fill level of the exhaust gas component reservoir is ascertained using a first system model to which signals of a first exhaust gas probe, which projects into the exhaust gas flow upstream from the catalytic converter and detects a concentration of the exhaust gas constituent, are delivered.

A "system model" is understood here as an algorithm that associates input variables, which also act on the real object simulated by the system model, with output variables, in such a way that the calculated output variables correspond as accurately as possible to the output variables of the real object. In the instance considered, the real object is the entire physical system located between the input variables and the output variables.

In the event of incomplete combustion of the air/fuel mixture in a spark-ignited engine, a plurality of combustion products, of which hydrocarbons (HC), carbon monoxide (CO), and nitrogen oxides ($NO_x$) are subject to regulatory limits, are emitted in addition to nitrogen ($N_2$), carbon dioxide ($CO_2$) and water ($H_2O$). According to the present existing art, the relevant exhaust gas limits can be complied with only by catalytic exhaust gas post-treatment. The aforesaid pollutant components can be converted by using a three-way catalytic converter.

A simultaneously high conversion rate for HC, CO, and $NO_x$ in three-way catalytic converters is achieved only in a narrow lambda range around the stoichiometric operating point (lambda=1) called the "conversion window."

In present-day engine control systems, a lambda regulation system that is based on the signals of lambda probes located before and after the three-way catalytic converter is typically used to operate the three-way catalytic converter in the conversion window. In order to regulate lambda (excess-air factor), which is an indicator of the composition of the fuel/air ratio of the internal combustion engine, the oxygen content of the exhaust gas before the three-way catalytic converter is measured using a front exhaust gas probe disposed there. Based on that measured value, the regulation system corrects the fuel quantity or injection pulse width, which is predefined in the form of a baseline value of a pilot control function.

In the context of the pilot control system, baseline values of fuel quantities to be injected are predefined, for example, on the basis of the rotation speed and load of the internal combustion engine. For even more accurate regulation, the oxygen concentration of the exhaust gas downstream from the three-way catalytic converter is additionally detected using a further exhaust gas probe. The signal of this rear exhaust gas probe is used for a master regulation operation that is overlaid on the lambda regulation before the three-way catalytic converter which is based on the signal of the front exhaust gas probe. It is usual to use, as the exhaust gas probe disposed after the three-way catalytic converter, a step-change lambda probe that possesses a very steep characteristic curve at lambda=1 and can therefore indicate lambda=1 very accurately (Kraftfahrzeugtechnisches Taschenbuch [Automotive Handbook], 23rd edition, page 524).

In addition to the master regulation system, which generally corrects only small deviations from lambda=1 and is designed to be comparatively slow, present-day engine control systems usually contain a functionality in the form of a lambda pilot control system that, following large deviations from lambda=1, ensures that the conversion window is rapidly returned to; this is important, for example, after phases with a coasting shutoff, in which the three-way catalytic converter becomes loaded with oxygen. This has a negative effect on $NO_x$ conversion.

Because of the oxygen storage capability of the three-way catalytic converter, a lambda=1 condition can still exist downstream from the three-way catalytic converter for several seconds even after a rich or lean lambda has been established before the three-way catalytic converter. This ability of the three-way catalytic converter to temporarily store oxygen is utilized in order to compensate for brief deviations from lambda=1 before the three-way catalytic converter. If a lambda not equal to 1 exists over a longer period before the three-way catalytic converter, the same lambda will also become established after the three-way catalytic converter as soon as the oxygen fill level, for a lambda>1 (oxygen excess), exceeds the oxygen storage capability; or, for a lambda<1, no further oxygen is stored in the three-way catalytic converter.

At that point in time, a step-change lambda probe after the three-way catalytic converter also indicates a departure from the conversion window. Until that point in time, however, the signal of the lambda probe located after the three-way catalytic converter does not indicate the impending breakout, and a master regulation function based on that signal often reacts so late that fuel metering can no longer react in timely fashion before a breakout. The result is that elevated tailpipe emissions occur. Present-day regulation concepts therefore have the disadvantage that based on the voltage of the step-change lambda probe after the three-way catalytic converter, they detect only in delayed fashion a departure from the conversion window.

An alternative to regulation on the basis of a lambda probe after the three-way catalytic converter is regulation of the average oxygen fill level of the three-way catalytic converter. This average fill level is not measurable, but in accordance German Patent Application No. DE 10 2016 222 108 A1 can be modeled by calculations.

A three-way catalytic converter is, however, a complex nonlinear system having time-variable system parameters. The measured or modeled input variables for a model of the three-way catalytic converter are furthermore usually affected by uncertainties. A generally valid catalytic converter model that can describe the behavior of the three-way catalytic converter with sufficient accuracy in different operating states (e.g. at different engine operating points or for different catalytic converter aging stages) is therefore not, as a rule, available in an engine control system.

In the method described in German Patent Application No. DE 10 2016 222 108 A1, a first system model that has an input emissions model, a catalytic converter model, and an output lambda model, among others, is used. The first system model calculates a modeled fill level of the catalytic converter, which is corrected to an emissions-optimized value. This, generally, will be an average fill level.

A shutoff of fuel delivery generally occurs during coasting phases of a motor vehicle, in which the internal combustion engine of the motor vehicle is being driven by its drive wheels. A large amount of oxygen is inputted into the catalytic converter in this instance. Because of the abrupt transitions between a coasting mode and a fueled mode in which combustion chamber charges are ignited and combusted, coasting phases represent a particular challenge for fill level modeling.

SUMMARY

The present invention differs from the existing art described in German Patent Application No. DE 10 2016 222 108 A1.

In the context of the present invention, a change in the actual fill level during a coasting phase of the internal combustion engine is predicted as a function of at least one of the following variables: raw emissions of at least one exhaust gas constituent, exhaust gas mass flow, exhaust gas temperature, catalytic converter temperature; values of these variables during the coasting phase being predicted from signals of sensors and control variables of the internal combustion engine which relate to the delivery or air and/or fuel to combustion chambers of the internal combustion engine.

In addition, instead of an analytic inversion of the first system model, a pilot control system that is designed as an inverted system model is used. The pilot control system possesses for that purpose a further internal system model that represents a copy of the first system model. The system in accordance with the existing art possesses two essential working states: "system observation" and "fill level regulation." The "observation" state becomes active, for example, when no combustion is active because of a coasting mode shutoff, and the fill level thus cannot be actively influenced. In the observation state, the internal system model of the pilot control system is calculated using the current combustion lambda measured by way of a lambda probe, so that the pilot control system can pilot-control an optimum fill level trajectory upon reactivation of the "fill level regulation" state.

Regulation of the fill level of the three-way catalytic converter on the basis of the signal of an exhaust gas probe disposed before the three-way catalytic converter has the advantage that an impending departure from the catalytic converter window can be recognized earlier than in the case of a master regulation system that is based on the signal of an exhaust gas probe located after the three-way catalytic converter, so that the departure from the catalytic converter window can be counteracted by a prompt, targeted correction of the air/fuel mixture.

Fill level regulation is shut off in coasting phases, since active influencing of the fill level is not possible because fuel delivery is shut off. The present invention is based on the recognition that the exhaust gas whose lambda value is being measured at the installation location of the first exhaust gas probe before the catalytic converter requires a transit time to travel the distance between the combustion chambers and the exhaust gas probe. When fill level regulation is switched back on, which occurs when a coasting phase ends, a residual quantity of exhaust gas is therefore still present between the combustion chamber and the first exhaust gas probe. According to the existing art, this residual quantity of exhaust gas is no longer taken into consideration by the pilot control system, since the latter must already predefine the fill level trajectory and the control variable and must correctly update the fill level, to be calculated using the numerically inverted system model and the currently available values, with those values.

As a result, in particular after short coasting phases that occur, for instance, during shifting operations, the inverted system model of the pilot control system indicates a fill level that is too low. The result of this is that following a fuel shutoff during coasting, the catalytic converter is not returned to the catalytic converter window at optimum speed. In some circumstances, the catalytic converter window (i.e., a fill level that is favorable for pollutant conversion) is reached only as a result of regulation system interventions or by way of a reinitialization mechanism that is triggered in a context of large deviations between the modeled output lambda and the lambda measured with an exhaust gas probe located after the catalytic converter.

The present invention improves the shutoff and compensation behavior of the fill level regulation function, and thus speeds up establishment of a catalytic converter fill level that is favorable for conversion. The overall result is thus improved regulation of an oxygen quantity stored in the catalytic converter volume, with which a departure from the conversion window is promptly recognized and prevented, and which at the same time has a more balanced fill level reserve than existing regulation concepts. This is advantageous in terms of compensating for dynamic disruptions that occur not only at transitions between operation with and without fuel shutoff but also with rapid changes in operating point, for instance under heavy acceleration. Emissions can thereby be reduced. Stricter regulatory requirements can be complied with at lower cost for the three-way catalytic converter.

A preferred embodiment is notable for the fact that the calculation, occurring as a function of the signals of the sensors and control variables that relate to the delivery of air and/or fuel to combustion chambers of the internal combustion engine, of the baseline lambda setpoint occurs for the length of a gas transit time span required by the exhaust gas, which results from combustion events of combustion chamber charges which resume after the coasting phase, to reach the first exhaust gas probe; or that the calculation of the baseline lambda setpoint which occurs as a function of the signals of the sensors and control variables occurs for the length of the coasting phase if the coasting phase is shorter than the gas transit time.

A further preferred embodiment is notable for the fact that the actual fill level of the exhaust gas component reservoir is ascertained using a first system model to which the signals of the first exhaust gas probe, which projects into the exhaust gas flow upstream from the catalytic converter and detects a concentration of the exhaust gas constituent, are delivered, and in which a baseline lambda setpoint for a first control loop in an operating mode occurring with fuel metering to combustion chambers of the internal combustion engine is predefined by a second control loop; that the baseline lambda setpoint is converted, by a second system model identical to the first system model, into a fictitious fill level; that the fictitious fill level is compared with a setpoint, outputted by a setpoint generator, for the fill level; that the baseline lambda setpoint is iteratively modified as a function of the comparison result if the comparison result produces a difference between the setpoint for the fill level and the fictitious fill level which is greater than a predefined magnitude; that the baseline lambda setpoint is not modified if the comparison result does not produce a difference between the setpoint for the fill level and the fictitious fill level which is greater than the predefined magnitude; and that the baseline lambda setpoint is calculated, at the beginning of a coasting phase of the internal combustion engine in which no fuel metering into the combustion chambers is occurring, as a function of signals of sensors and control variables of the internal combustion engine which relate to the delivery of air and/or fuel to combustion chambers of the internal combustion engine.

It is also preferred that a check be made as to whether the internal combustion engine is still in coasting mode; that if that is not the case, a calculation of baseline lambda setpoints occurs by defining baseline lambda setpoints for a fueled mode; and that if the internal combustion engine is still in coasting mode, a check is made as to whether the time elapsed since the transition into coasting mode with fuel shutoff is longer than the gas transit time.

It is also preferred that when the time elapsed since the transition into the coasting mode with fuel shutoff is longer than the gas transit time, signals of the first exhaust gas probe be used as baseline lambda setpoints.

A further preferred embodiment is notable for the fact that a check is made as to whether the internal combustion engine is still in coasting mode; and that if that is not the case, a calculation of baseline lambda setpoints occurs by defining baseline lambda setpoints for a fueled mode.

It is also preferred that a deviation of the actual fill level from the predetermined fill level setpoint be ascertained and be processed by a fill level regulation system to yield a lambda setpoint correction value; that a sum of the baseline lambda setpoint and the lambda setpoint correction value be calculated; and that the sum be used to calculate a correction value with which a metering of fuel to at least one combustion chamber of the internal combustion engine is influenced.

It is further preferred that the exhaust gas component be oxygen; that in the first control loop, a lambda regulation operation occur in which the signal of the first exhaust gas probe is processed as an actual lambda value; and that the lambda setpoint be calculated in the second control loop; and a fill level system deviation, constituting a deviation of the fill level modeled with the first catalytic converter model from the filtered fill level setpoint, being calculated; that fill level system deviation being delivered to a fill level regulation algorithm that calculates therefrom a lambda setpoint correction value; and that lambda setpoint correction value being added to the, optionally iteratively modified, baseline lambda setpoint; and the sum thereby calculated constituting the lambda setpoint.

A further preferred embodiment is notable for the fact that the catalytic converter model has an output lambda model that is configured to convert concentrations, calculated with the aid of the first catalytic converter model, of the individual exhaust gas components into a signal that is comparable with the signal of a second exhaust gas probe that is disposed downstream from the catalytic converter and is exposed to the exhaust gas.

An embodiment of a control unit according to the present invention is notable for the fact that it is configured to control the execution of a method in accordance with one of the embodiments of the method.

Further advantages are evident from the description and from the Figures.

It is understood that the features recited above and those yet to be explained below are usable not only in the respective combination indicated but also in other combinations or in isolation, without departing from the scope of the present invention.

Exemplifying embodiments of the present invention are depicted in the figures and are explained in further detail in the description below. Identical reference characters in different Figures respectively identify elements that are identical or at least comparable in terms of their function.

DETAILED DESCRIPTION OF EXAMPLE EMBODIMENTS

The present invention is described below using the example of a three-way catalytic converter, and for oxygen as an exhaust gas component that is to be stored. The present invention is also applicable analogously, however, to other types of catalytic converter and to other exhaust gas components such as nitrogen oxides and hydrocarbons. In the interest of simplicity, what follows is based on an exhaust system having one three-way catalytic converter. The present invention is also applicable analogously to exhaust systems having several catalytic converters. The front and rear zones described below can extend in that case over several catalytic converters or can be located in different catalytic converters.

Figure 1:
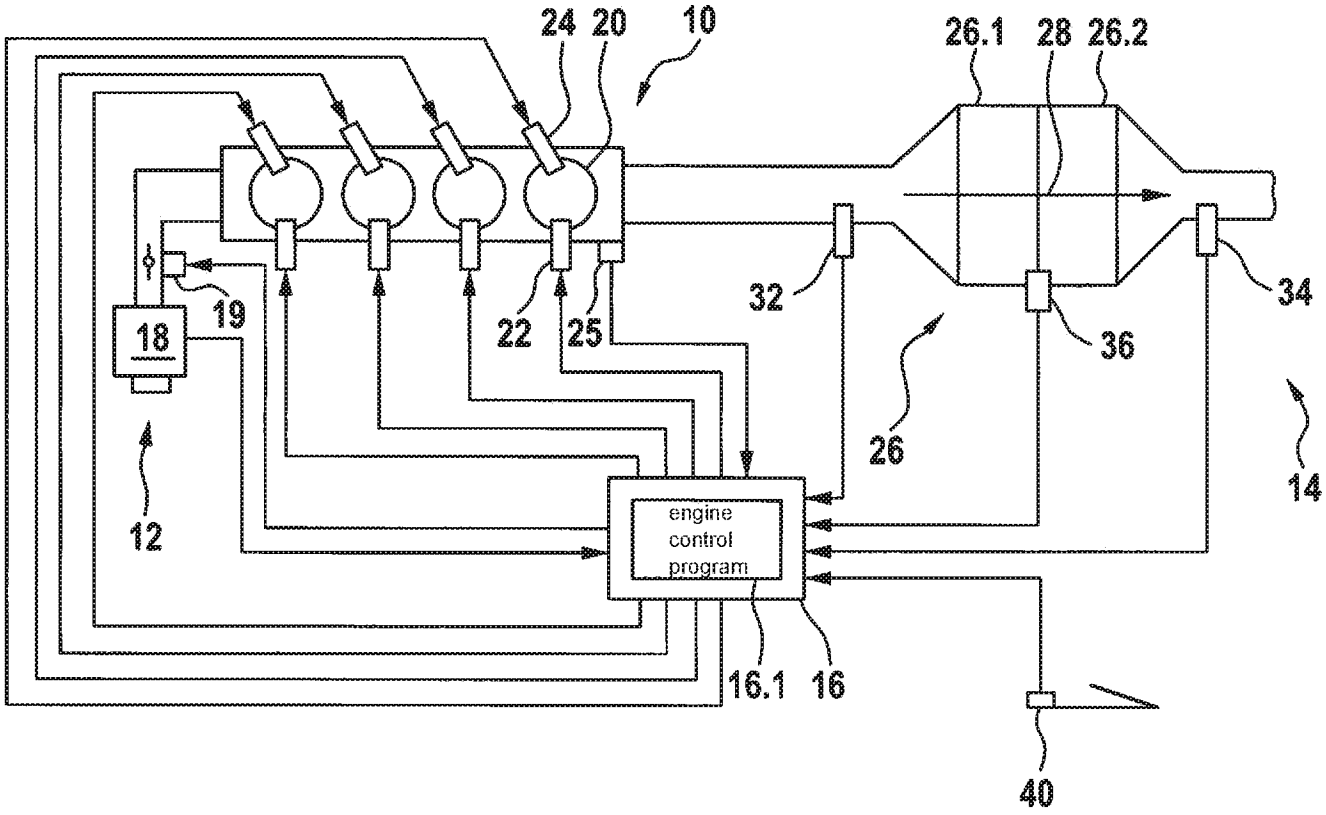
FIG. 1 shows an internal combustion engine having an exhaust system, constituting the technical environment of the present invention.

FIG. 1 shows an internal combustion engine 10 having an air delivery system 12, an exhaust system 14, and a control unit 16. An air mass sensor 18, and a throttle flap, disposed downstream from air mass sensor 18, of a throttle valve unit 19, are disposed in air delivery system 12. The air flowing via air delivery system 12 into internal combustion engine 10 is mixed in combustion chambers 20 of internal combustion engine 10 with gasoline that is injected via injection valves 22 directly into combustion chambers 20. The present invention is not limited to internal combustion engines with direct injection, and can also be used with indirect injection or with internal combustion engines that use gas. The resulting combustion chamber charges are ignited with ignition apparatuses 24, for example spark plugs, and combusted. A rotation angle sensor 25 detects the rotation angle of a shaft of internal combustion engine 10, and thereby permits control unit 16 to trigger the ignition events at predetermined angular positions of the shaft. The exhaust gas resulting from the combustion events is discharged via exhaust system 14.

Exhaust system 14 has a catalytic converter 26. Catalytic converter 26 is, for instance, a three-way catalytic converter that, as is known, converts the three exhaust gas constituents nitrogen oxides, hydrocarbons, and carbon monoxide on three reaction pathways, and has an oxygen-storing effect. Because of the oxygen-storing effect and because oxygen is an exhaust gas constituent, the catalytic converter possesses an exhaust gas component reservoir. In the example depicted, three-way catalytic converter 26 has a first zone 26.1 and a second zone 26.2. Exhaust gas 28 flows through both zones. The first, front zone 26.1 extends in a flow direction over a front region of three-way catalytic converter 26. The second, rear zone 26.2 extends, downstream from first zone 26.1, over a rear region of three-way catalytic converter 26. Further zones, for which the respective fill level is likewise modeled as applicable using a calculation model, can of course be located before front zone 26.1 and after rear zone 26.2, and between the two zones.

Upstream from three-way catalytic converter 26, a front exhaust gas probe 32 exposed to exhaust gas 28 is disposed immediately before three-way catalytic converter 26. Downstream from three-way catalytic converter 26, a rear exhaust gas probe 34 that is likewise exposed to exhaust gas 28 is disposed immediately after three-way catalytic converter 26. Front exhaust gas probe 32 is preferably a broadband lambda probe that permits a measurement of the excess-air factor A over a wide range of excess-air factor. Rear exhaust gas probe 34 is preferably a so-called step-change lambda probe with which the excess-air factor $\lambda=1$ can be measured particularly accurately, since the signal of this exhaust gas probe 34 changes abruptly at that point (see Bosch, Kraftfahrzeugtechnisches Taschenbuch [Automotive Handbook], 23rd edition, page 524).

In the exemplifying embodiment depicted, a temperature sensor 36 exposed to exhaust gas 28 is disposed in three-way catalytic converter 26 in thermal contact with exhaust gas 28, and detects the temperature of three-way catalytic converter 26.

Control unit 16 processes the signals of air mass sensor 18, of rotation angle sensor 25, of front exhaust gas probe 32, of rear exhaust gas probe 34, and of temperature sensor 36, and calculates therefrom control application signals for adjusting the angular position of the throttle valve, triggering ignition events by ignition apparatus 24, and injecting fuel by way of injection valves 22. Alternatively or additionally, control unit 16 also processes signals of other or further sensors for applying control to the actuating members depicted or also to further or other actuating members, for instance the signal of a driver input generator 40 that detects an accelerator position. A coasting mode with shutoff of fuel delivery is triggered, for example, by releasing the accelerator pedal. This function, and the functions yet to be explained below, are performed by an engine control program 16.1 that executes in control unit 16 during the operation of internal combustion engine 10.

This Application refers to a system model 100, to a catalytic converter model 102, to an inverse catalytic converter model in the form of a pilot control system 136 (see FIG. 3), and to an output lambda model 106. Each model is an algorithm, in particular a system of equations, which is executed or calculated in control unit 16 and which associates input variables, which also act on the real object simulated with the computational model, with output variables in such a way that the calculated output variables correspond as accurately as possible to the output variables of the real object.

Figure 2:
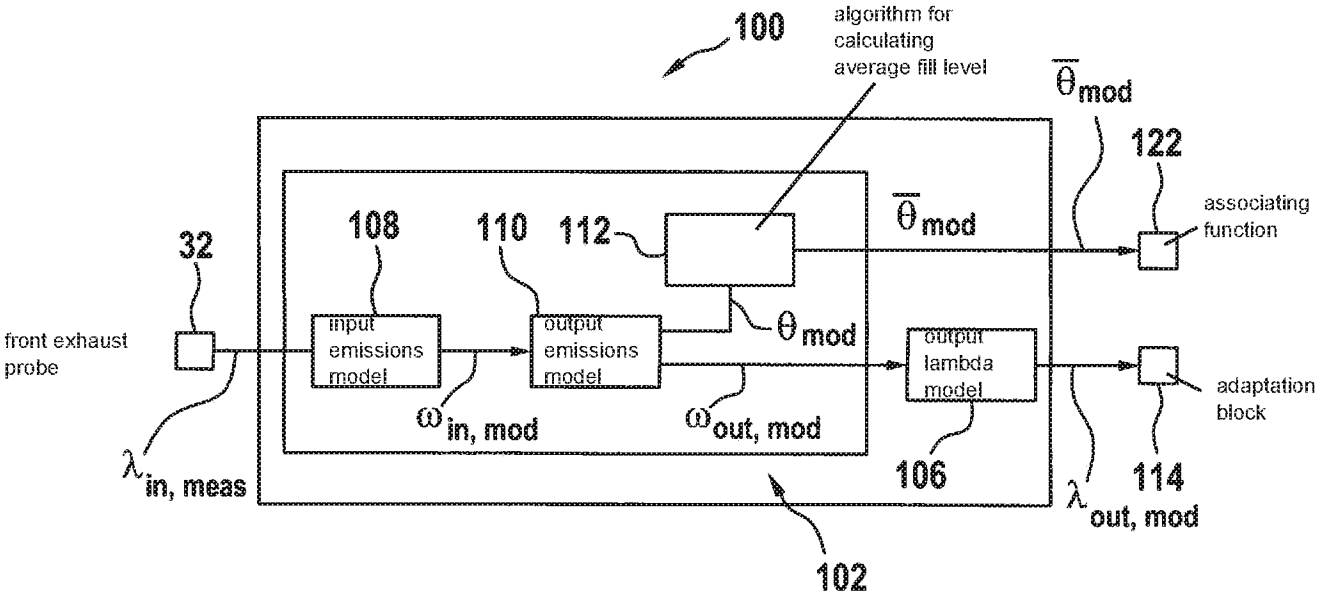
FIG. 2 is a functional block depiction of a system model.

FIG. 2 is a functional block depiction of a system model 100. System model 100 is made up of catalytic converter model 102 and output lambda model 106. Catalytic converter model 102 encompasses an input emissions model 108 and a fill level and output emissions model 110. Catalytic converter model 102 furthermore has an algorithm 112 for calculating an average fill level $\bar{\theta}_{mod}$ of catalytic converter 26.

Input emissions model 108 is configured to convert the signal $\lambda_{in,meas}$ of exhaust gas probe 32 disposed before three-way catalytic converter 26, constituting an input variable, into input variables $w_{in,mod}$ required for the downstream fill level model 110. For example, a conversion of lambda into the concentrations of $O_2$, CO, $H_2$, and HC before three-way catalytic converter 26 using input emissions model 108 is advantageous.

With the variables $w_{in,mod}$ calculated by input emissions model 108, and optionally additional input variables (e.g. exhaust gas temperature or catalytic converter temperature, exhaust gas mass flow, and current maximum oxygen storage capacity of three-way catalytic converter 26), a fill level $\theta_{mod}$ of three-way catalytic converter 26, and concentrations $w_{out,mod}$ of the individual exhaust gas components at the output of three-way catalytic converter 26, are modeled in fill level and output emissions model 110.

In order to allow filling and emptying processes to be modeled more realistically, three-way catalytic converter 26 is preferably notionally divided by the algorithm into several zones or partial volumes 26.1, 26.2 located one behind another in the flow direction of exhaust gases 28, and the concentrations of the individual exhaust gas constituents are ascertained for each of these zones 26.1, 26.2 with the aid of the reaction kinetics. These concentrations can in turn be respectively converted into a fill level of the individual zones 26.1, 26.2, preferably into the oxygen fill level normalized to the current maximum oxygen storage capacity.

The fill levels of individual, or all, zones 26.1, 26.2 can be combined by suitable weighting into a total fill level that reflects the state of three-way catalytic converter 26. In the simplest case, for instance, the fill levels of all zones 26.1, 26.2 can all be weighted equally, and an average fill level can thereby be ascertained. With suitable weighting, however, it is also possible to take into account the fact that the fill level in a comparatively small zone 26.2 at the output of three-way catalytic converter 26 is critical in terms of the instantaneous exhaust gas composition after three-way catalytic converter 26, while the fill level in zone 26.1 located before it, and the development thereof, are critical in terms of the development of the fill level in that small zone 26.2 at the output of three-way catalytic converter 26. In the interest of simplicity, an average oxygen fill level will be assumed hereinafter.

The algorithm of output lambda model 106 converts the concentrations $w_{out,mod}$ of the individual exhaust gas components at the output of catalytic converter 26, calculated with catalytic converter model 102, for adaptation of system model 100, into a signal $\lambda_{out,mod}$ that can be compared with the signal $\lambda_{out,meas}$ of exhaust gas probe 34 disposed after catalytic converter 26. It is preferably the lambda after three-way catalytic converter 26 that is modeled. Output lambda model 106 is not absolutely necessary for pilot control on the basis of an oxygen fill level setpoint.

System model 100 thus serves on the one hand to model at least one average fill level $\overline{\theta}_{mod}$ of catalytic converter 26, which is corrected to a fill level setpoint at which catalytic converter 26 is definitely within the catalytic conversion window. On the other hand, system model 100 makes available a modeled signal $\lambda_{out,mod}$ of exhaust gas probe 34 located after catalytic converter 26. The manner in which this modeled signal $\lambda_{out,mod}$ of the rear exhaust gas probe 34 is advantageously used to adapt system model 100 will be explained in further detail later on. Adaptation is performed in order to compensate for uncertainties that affect the input variables of the system model, in particular the signal of the lambda probe before the catalytic converter. The pilot control system, and optionally controller parameters, are also adapted.

Figure 3:
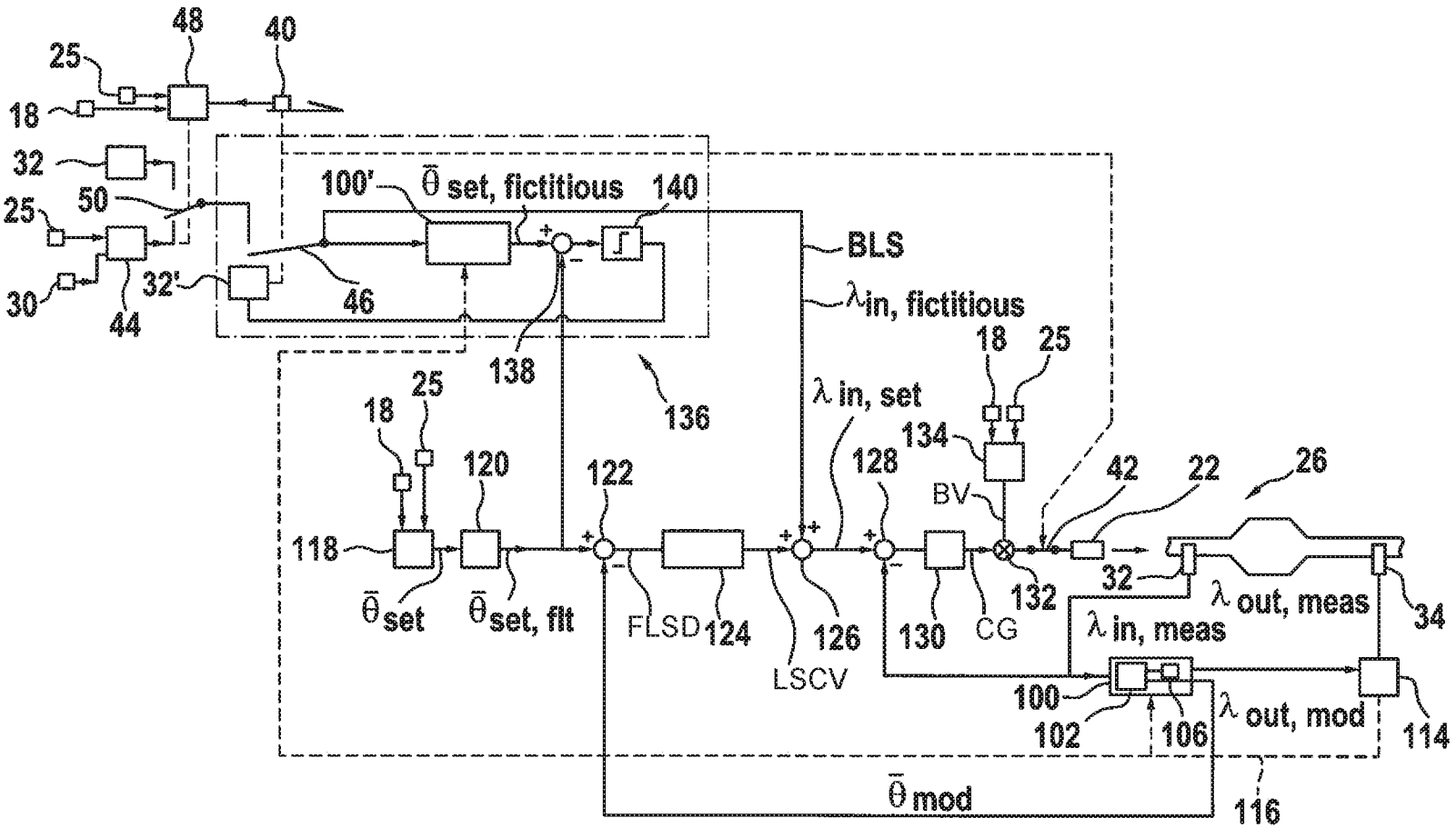
FIG. 3 is a functional block depiction of a method and control unit according to the present invention.

FIG. 3 is a functional block depiction of a method, together with apparatus elements that act on the functional blocks or are influenced by the functional blocks.

In specific, FIG. 3 shows the manner in which the signal $\lambda_{out,mod}$ of rear exhaust gas probe 34 modeled by output lambda model 106 is reconciled with the real output signal $\lambda_{out,meas}$ of rear exhaust gas probe 34. For this, the two signals $\lambda_{out,mod}$ and $\lambda_{out,meas}$ are delivered to an adaptation block 114. Adaptation block 114 compares the two signals $\lambda_{out,mod}$ and $\lambda_{out,meas}$ with one another. For example, a step-change lambda probe that is disposed after three-way catalytic converter 26 and constitutes exhaust probe 34 indicates unequivocally when three-way catalytic converter 26 is completely filled with oxygen or completely emptied of oxygen. This can be utilized, after lean or rich phases, to bring the modeled oxygen fill level into agreement with the actual oxygen fill level, or to bring the modeled output lambda $\lambda_{out,mod}$ into agreement with the lambda $\lambda_{out,meas}$ measured after three-way catalytic converter 26, and to adapt system model 100 in the event of deviations. Adaptation is accomplished, for instance, by the fact that adaptation block 114 successively modifies parameters of the algorithm of system model 100, via adaptation path 116 depicted as a dashed line, until the lambda value $\lambda_{out,mod}$ modeled for the exhaust gas flowing out of three-way catalytic converter 26 corresponds to the lambda value $\lambda_{out,meas}$ measured there.

Inaccuracies in measured or modeled variables that are involved in system model 100 are thereby compensated for. From the fact that the modeled value $\lambda_{out,mod}$ corresponds to the measured lambda value $\lambda_{out,meas}$ it can be inferred that the fill level $\overline{\theta}_{mod}$ modeled with system model 100, or with first catalytic converter model 102, also corresponds to the fill level (not measurable with onboard means) of three-way catalytic converter 26. It can then further be inferred that a pilot control system 136, which represents a catalytic converter model that is inverse to first catalytic converter model 102 and is obtained by mathematical transformation from the algorithm of first catalytic converter model 102, also correctly describes the behavior of the system that is being modeled. Pilot control system 136 encompasses a second system model 100' whose system of equations is identical to the system of equations of first system model 100 but is supplied with different input variables. With pilot control system 136, system model 100 is numerically inverted. The reason for this is that a catalytic converter is a complex, nonlinear system having time-variable system parameters that, as a rule, can be represented only by a nonlinear system of differential equations. The result of this is typically that the system of equations for the inverted system model cannot be solved, or can be solved only with great effort, analytically. These difficulties are avoided by pilot control system 136 implemented as a numerical inversion.

The output variable of pilot control system 136 is a baseline lambda setpoint BLS. Pilot control system 136 has delivered to it for that purpose, as an input variable, a fill level setpoint $\overline{\theta}_{set,flt}$ filtered by an optional filtering function 120. Filtering function 120 is performed for the purpose of permitting only those changes to the input variable of inverse second catalytic converter model 104 which the controlled system as a whole can follow. An as-yet unfiltered setpoint $\overline{\theta}_{set}$ is read out from a memory 118 of control unit 16. Memory 118 is preferably addressed for that purpose with current operating characteristic values of internal combustion engine 10. The operating characteristic values are, for instance but not obligatorily, the rotation speed (detected by rotation speed sensor 25) and the load (detected by air mass sensor 18) of internal combustion engine 10.

The filtered fill level setpoint $\overline{\theta}_{set,flt}$ is processed by pilot control system 136 to yield a baseline lambda setpoint BLS. In parallel with this processing, in an associating function 122 a fill level system deviation FLSD is calculated, constituting the deviation of the modeled fill level $\overline{\theta}_{mod}$, modeled with system model 100 or with first catalytic converter model 102, from the filtered fill level setpoint $\overline{\theta}_{set,flt}$. This fill level system deviation FLSD is delivered to a fill level regulation algorithm 124 that calculates therefrom a lambda setpoint correction value LSCV. This lambda setpoint correction value LSCV is added, in associating function 126, to the baseline lambda setpoint BLS calculated by the pilot control system.

The sum thereby arrived at can serve as a setpoint $\lambda_{in,set}$ of a conventional lambda regulation system. In an associating function 128, the actual lambda value $\lambda_{in,meas}$ furnished by first exhaust gas probe 32 is subtracted from this lambda setpoint $\lambda_{in,set}$. The system deviation SD thereby calculated is converted by a usual regulation algorithm 130 into a control variable CV that, in an associating function 132, is associated, for example by multiplication, with a baseline value BV, predetermined as a function of operating parameters of internal combustion engine 10, of an injection pulse width $t_{inj}$. The baseline values BV are stored in a memory 134 of control unit 16. Here as well, the operating parameters are preferably, but not obligatorily, the load and the rotation speed of internal combustion engine 10. Using the injection pulse width $t_{inj}$ resulting from the product, fuel is injected via injection valves 22 into combustion chambers 20 of internal combustion engine 10.

The conventional lambda regulation occurring in a first control loop is thereby overlain by a regulation of the oxygen fill level of catalytic converter 26, which occurs in a second control loop. Elements 22, 32, 128, 130, and 132 constitute a first control loop in which a lambda regulation process occurs in which the signal $\lambda_{in,meas}$ of first exhaust gas probe 32, constituting an actual lambda value, is processed. The lambda setpoint $\lambda_{in,set}$ of the first control loop is calculated in a second control loop that has elements 22, 32, 100, 122, 124, 126, 128, 130, 132.

The average oxygen fill level $\overline{\theta}_{mod}$ modeled using system model 100 or first catalytic converter model 102 is corrected, for instance, to a setpoint $\overline{\theta}_{set,flt}$ that minimizes the probability of breakouts toward lean and rich, and thus results in minimal emissions. Because the baseline lambda setpoint BLS is calculated by pilot control system 136, the system deviation of the fill level regulation system becomes equal to zero when the modeled average fill level $\overline{\theta}_{mod}$ is identical to the prefiltered fill level setpoint $\overline{\theta}_{set,\ flt}$. Fill level regulation algorithm 124 intervenes only when this is not the case. Because the calculation of the baseline lambda setpoint, which acts to a certain extent as a pilot control system 136 for the fill level regulation system, is realized as a numerical inversion of first catalytic converter model 102, this pilot control system 136 can be adapted, analogously to the adaptation of first catalytic converter model 102, on the basis of the signal $\lambda_{in,meas}$ of second exhaust gas probe 34 disposed after three-way catalytic converter 26. This is illustrated in FIG. 3 by the branch of adaptation path 116 which leads to inverted system model 104.

This realization of pilot control system 136 as an inversion of system model 100 has the advantage that fill level regulation algorithm 124 needs to intervene only when the actual fill level of the catalytic converter, modeled with the aid of the system model, deviates from the filtered setpoint fill level $\overline{\theta}_{set,flt}$ or from the unfiltered fill level setpoint $\overline{\theta}_{set}$. While system model 100 converts the input lambda before the catalytic converter into an average oxygen fill level of the catalytic converter, pilot control system 136, constituting an inverted system model, converts the average oxygen fill level setpoint into a corresponding lambda setpoint before the catalytic converter.

The consideration underlying the subject matter of FIG. 3 is as follows: Using an actual lambda value generator block 32', a fictitious value $\lambda_{in,fictitious}$ is initially predefined as an input variable for second system model 100' of pilot control system 136. The initial fictitious value $\lambda_{in,fictitious}$ serves as an initial baseline lambda setpoint for fueled operation of internal combustion engine 10 (i.e. normal operation with fuel metering and combustion of combustion chamber charges), and is outputted, as the method is later cycled through, as an updated baseline lambda setpoint BLS. With second system model 100', what results from this input variable is a fictitious value $\overline{\theta}_{set,fictitious}$ for the average oxygen fill level of catalytic converter 26. In associating function 138, the difference between the fictitious average fill level $\overline{\theta}_{set,fictitious}$ and the fill level setpoint $\overline{\theta}_{set,flt}$ filtered by the optional filtering function 120, or the unfiltered fill level setpoint $\overline{\theta}_{set}$, is calculated. If the two values $\overline{\theta}_{set,fictitious}$ and $\overline{\theta}_{set,flt}$ (or $\overline{\theta}_{set}$) are identical, the difference is equal to zero. This means that the predefined fictitious lambda value $\lambda_{in,fictitious}$ corresponds specifically to the lambda setpoint BLS that must be pilot-controlled in order to reach the oxygen fill level setpoint. In threshold value block 140, the difference between the fictitious average fill level $\overline{\theta}_{set,fictitious}$ and the fill level setpoint $\overline{\theta}_{set,flt}$ filtered by the optional filtering function 120, or the unfiltered fill level setpoint $\overline{\theta}_{set}$, is compared with a predefined threshold value. If the absolute value of the difference is sufficiently small (which can be set by selecting the magnitude of the threshold value), threshold block 140 then conveys to actual lambda value generator block 32' a signal representing that fact. As a reaction to that signal, actual lambda value generator block 32' thus retains its output signal $\lambda_{in,fictitious}$ thereby acknowledged as correct, and conveys that signal to associating function 126 as a baseline lambda setpoint BLS.

If the difference between the fictitious average fill level $\overline{\theta}_{set,fictitious}$ and the fill level setpoint $\overline{\theta}_{set,flt}$ filtered by the optional filtering function 120, or the unfiltered fill level setpoint $\overline{\theta}_{set}$, is greater than the threshold value, however, this means that the predefined fictitious lambda value $\overline{\theta}_{set,fictitious}$ does not yet correspond to the ideal lambda setpoint BLS that must be pilot-controlled in order to reach the oxygen fill level setpoint. In threshold value block 140, the difference between the fictitious average fill level $\overline{\theta}_{set,fictitious}$ and the fill level setpoint $\overline{\theta}_{set,flt}$ filtered by the optional filtering function 120, or the unfiltered fill level setpoint $\overline{\theta}_{set}$, will then exceed the predefined threshold value. In this case threshold value block 140 conveys to actual lambda value generator block 32' a signal representing that fact. In reaction to that signal, actual lambda value generator block 32' begins to iteratively vary its output signal $\lambda_{in,fictitious}$, thereby acknowledged as incorrect, and conveys the iteratively varying output signal BLS in particular to system model 100'. This second (with respect to first system model 100) system model 100' is then iterated, using identical parameters and initially identical state variables with respect to first system model 100, with a variable input lambda $\lambda_{in,fictitious}$ or BLS, until the difference between the fill level $\overline{\theta}_{set,fictitious}$ calculated by second system model 100' and the filtered fill level setpoint $\overline{\theta}_{set,flt}$ or the unfiltered fill level setpoint $\overline{\theta}_{set}$ has a sufficiently small absolute value that the required pilot control system accuracy can be reached. The required accuracy can be adjusted by selecting the threshold value in block 140. The value thereby arrived at for the input lambda $\lambda_{in,fictitious}$ is then used as a baseline lambda setpoint BLS for the first control loop. The difference calculation represents simply an embodiment of a comparison of the fictitious average fill level $\overline{\theta}_{set,fictitious}$ with the fill level setpoint $\overline{\theta}_{set,flt}$ filtered by the optional filtering function 120, or with the unfiltered fill level setpoint $\overline{\theta}_{set}$. A comparison can also be made, for instance, on the basis of calculation of a quotient.

The advantage of this procedure is that only the system of equations for the forward system model 100 or 100' needs to be solved again, but not the equation system (not solvable or solvable only with great calculation outlay) of an analytical inversion of first system model 100.

In order to minimize calculation outlay in control unit 16, it is preferable to define iteration limits for the input lambda $\lambda_{in,fictitious}$ which determine the range in which the iteration is carried out. The iteration limits are preferably defined as a function of the current operating conditions. For instance, it is advantageous to carry out the iteration only within the smallest possible range around the lambda setpoint BLS that is to be expected. It is also advantageous, when defining the iteration limits, to take into account the effect of fill level regulation system 124, and effects of other functionalities, on the lambda setpoint BLS.

The system of equations that is to be solved is solved iteratively within this range using inclusion methods such as bisection methods or regula falsi. Inclusion methods such as regula falsi are commonly known. They are notable for the fact that they not only supply iterative approximate values, but also limit them from both sides. The calculation outlay for determining the correct baseline lambda setpoint BLS is thereby considerably limited.

This description applies to a normal operating mode of the internal combustion engine, in which a fuel/air mixture is being combusted in the combustion chambers. In coasting mode, fuel delivery to the combustion chambers as a rule is shut off. This is represented in FIG. 3 by the connection between driver input generator 40 and a switch 42. When the internal combustion engine is being driven by the drive wheels of the motor vehicle, which can be recognized by the control unit, for instance, by evaluating the signal of driver input generator 40, switch 42 is opened so that fuel injection valves 22 are not activated to open.

The baseline lambda setpoint BLS is calculated, at the beginning of a coasting phase of internal combustion engine 10 in which no fuel is being metered to combustion chambers 20, as a function of signals of sensors and control variables of internal combustion engine 10 which relate to the delivery of air and/or fuel to combustion chambers of internal combustion engine 10. This is represented in FIG. 3 by block 44 and by switches 46 and 50. Block 44 outputs baseline lambda setpoints BLS that are calculated as a function of signals of sensors and control variables of internal combustion engine 10 which relate to the delivery of air and/or fuel to combustion chambers of the internal combustion engine. Switch 46 is actuated, in parallel with switch 42, at the transition into coasting mode, and the actuation is triggered, for instance, by driver input generator 40. Switch 46 is actuated in such a way that the input of system model 100' of pilot control system 136 is present at the output of block 44 (i.e. is connected to the output of block 44).

The baseline lambda setpoint BLS is then no longer being outputted by setpoint generator block 32' but instead is outputted by block 44, the output occurring as a function of signals of sensors and control variables of the internal combustion engine which relate to the delivery of air and/or fuel to combustion chambers of the internal combustion engine. Examples of such sensors are air mass sensor 18 and rotation angle sensor 25.

In block 48, a gas transit time, starting at the onset of fuel shutoff, required by exhaust gas 28 to travel from combustion chambers 20 of internal combustion engine 10 to first exhaust gas probe 32 is determined during coasting mode. The gas transit time is determined, for instance, by calculations of a gas transport model calculated in control unit 16. Input variables for a gas transport model of this kind are, for instance, the signals of air mass sensor 18 and of rotation angle sensor 25.

Once the gas transit time has elapsed, block 48 triggers an actuation of switch 50 with which the furnishing of the baseline lambda setpoint BLS effected by block 44 is aborted and is replaced by furnishing of the baseline lambda setpoint effected on the basis of the signal of first exhaust gas probe 32. The input of system model 100' of pilot control system 136 is then present at the output of block 32 (i.e., it is connected to the output of block 32).

When coasting mode is terminated, which occurs e.g. by way of an actuation of driver input generator 40, switch 46 in particular is actuated again so that the baseline lambda setpoint BLS is again being outputted by setpoint generator block 32'.

In the context of the subject matter of FIG. 3, an adaptation of system model 100' of the pilot control system is accomplished by way of path 116 that leads from block 114 to second system model 100'. All the elements depicted in FIG. 3, with the exception of exhaust system 26, exhaust gas probes 32, 34, air mass sensor 18, rotation angle sensor 25, and injection valves 22, are constituents of a control unit 16 according to the present invention. All the other elements of FIG. 3, with the exception of memories 118, 134, are parts of an engine control program 16.1 that is stored, and executes, in control unit 16.

Figure 4A:
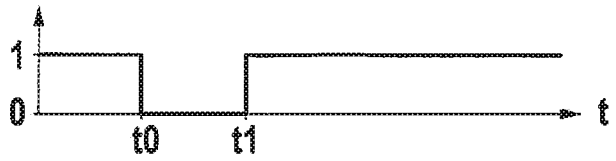
FIGS. 4A-4D shows time courses of binary states that occur in the context of a temporary interruption in fuel delivery.

FIGS. 4A-4D shows time courses of binary states that occur in the context of the existing art and, in comparison therewith, in the context of the invention in conjunction with a temporary interruption in fuel delivery. Level 1 in FIG. 4A represents a state in which fuel is being delivered to the internal combustion engine via fuel injection valves 22. This is the case for times $t<t0$ and $t>t1$. Level 0 represents a shut-off fuel delivery. Fuel delivery is shut off between times t0 and t1.

Figure 4B:
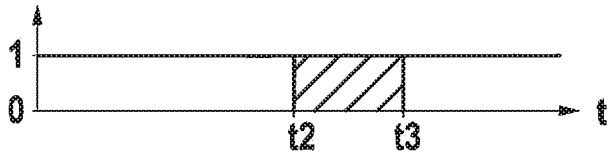

Level 1 in FIG. 4B represents a state in which exhaust gas probe 32 is reproducing fuel delivery in its signal. This is the case for times $t<t2$ and $t>t3$. Level 0 represents a state in which first exhaust gas probe 32 is reproducing the shut-off fuel delivery in its signal. This is the case for times $t2<t<t3$. FIG. 4B is, in a sense, a phase-shifted image of FIG. 4A, the time-related phase shift $t2-t0$, $t3-t1$ being the gas transit time of the exhaust gas between the combustion chambers and first exhaust gas probe 32.

Figure 4C:
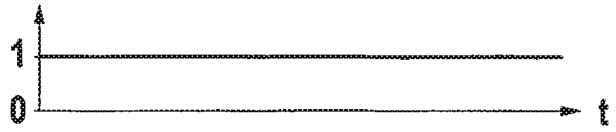
Figure 4D:
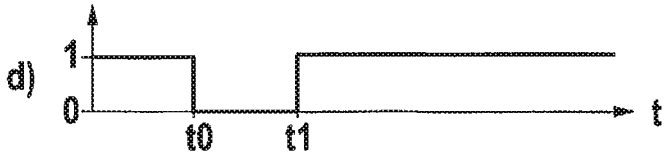

Level 1 in FIG. 4D represents a state in which a baseline lambda setpoint BLS is defined, in the manner described above, by pilot control system 136 by repeated cycling through the loop made up of blocks 100', 138, 140, 32' in the context of the existing art. This is the case for times $t<t0$ and $t>t1$. Definition stops at time t0 at which fuel delivery is interrupted, since the result of the interrupted fuel delivery is that from then on the fill level of catalytic converter 26 can no longer be actively influenced by a setpoint definition, and instead its development can merely be observed.

In the context of observation, output signal $\lambda_{in,meas}$ of exhaust gas probe 32 disposed before three-way catalytic converter 26, constituting a first substitute value for the baseline lambda setpoint BLS calculated iteratively in the loop made up of blocks 100', 138, 140, 32', is used for the calculation of the oxygen fill level which occurs in system model 100' of pilot control system 136. As FIG. 4B shows, because of the phase shift or gas transit time this signal has a value of 1 in the time interval $t0<t<t1$. In the time interval $t2<t<t3$, first exhaust gas probe 32 reproduces the fuel shutoff but it is not registered by pilot control system 136 because the latter, in the time interval $t2<t<t3$, is already again processing the signal of setpoint generator block 32' rather than the signal of first exhaust gas probe 32. What therefore results as a time course of the input signal of system model 100' of pilot control system 136 in the context of the existing art is a continuous level 1, as depicted in FIG. 4C. The result of this is that brief shutoffs in fuel delivery, which are associated with an elevated oxygen input into catalytic converter 26, are not processed by system model 100' of the pilot control system. An undesired consequence is that the fill level modeled by system model 100' of pilot control 136 is lower than it is in reality. The cross-hatched region in FIG. 4B, which represents an oxygen input into the catalytic converter, is not taken into account in the existing art (see FIG. 4C).

The invention avoids this undesired effect by the fact that, immediately upon shutoff of fuel delivery, it applies the input of system model 100' of pilot control system 138 to the output of block 44. Block 44 reproduces the fuel shutoff without delay. This produces, for the invention, the profile depicted in FIG. 4D as an input signal of system model 100' of pilot control system 136. Here the oxygen input is taken into consideration in the calculation by system model 100' of pilot control system 136.

If the interruption in fuel delivery to the internal combustion engine is shorter than the gas transit time, the input of system model 100' of pilot control system 136 is applied again, still within the gas transit time, to the output of setpoint generator block 32' as fuel delivery resumes.

If the interruption in fuel delivery to the internal combustion engine is longer than the gas transit time, the input of system model 100' of pilot control system 136 is applied firstly to the output of block 44. If the gas transit time has then elapsed and the fuel shutoff persists, switch 50 is actuated, by block 48 that calculates the gas transit time, in such a way that upon expiration of the gas transit time, the input of system model 100' of pilot control system 136 is disconnected from block 44 and is connected to first exhaust gas probe 32. When fuel delivery switches back on, the input of system model 100' of pilot control system 136 is reconnected to setpoint generator block 32'.

Figure 5:
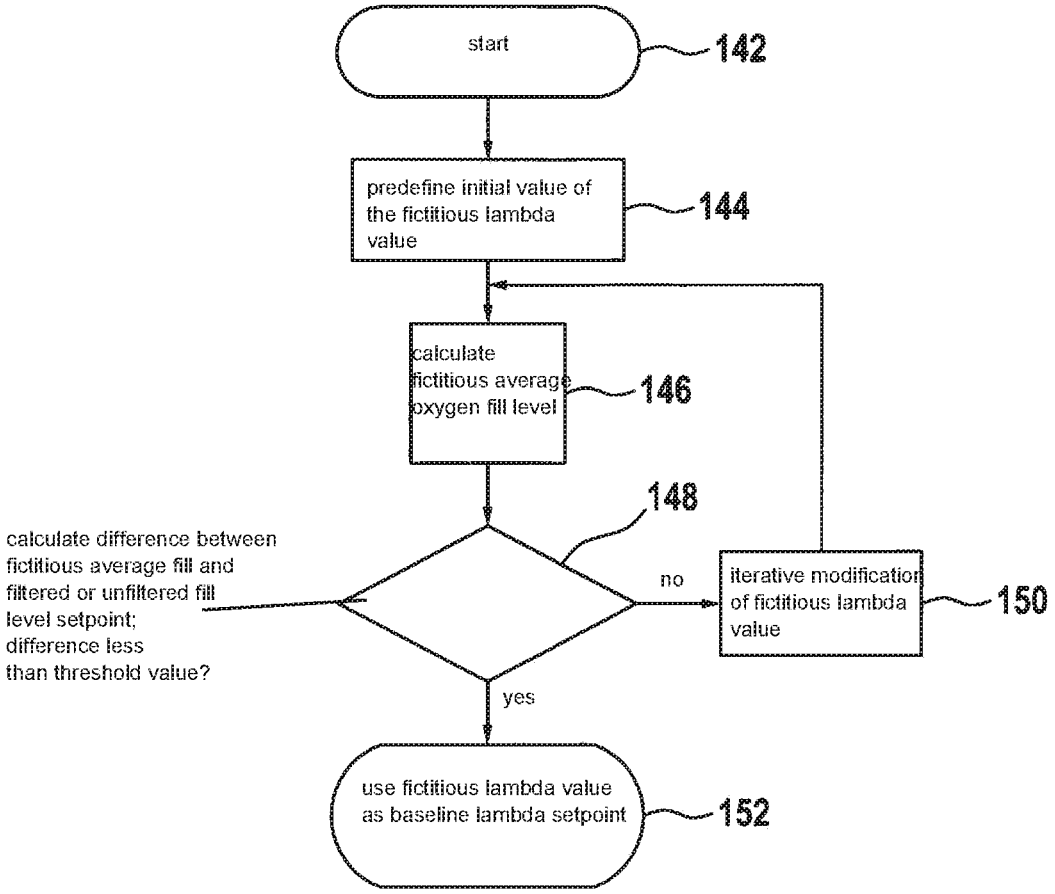
FIG. 5 is a flow chart constituting an exemplifying embodiment of a first part of a method according to the present invention.

FIG. 5 shows a flow chart constituting an exemplifying embodiment of a method for executing the pilot control function explained with reference to FIG. 3 as it executes, for example, outside a coasting mode. The flow chart is preferably executed as a sub-program of engine control program 16.1 of FIG. 1.

In step 142, a sub-program made up of higher-order parts of engine control program 16.1 is called. In step 144, an initial value of the fictitious lambda value $\lambda_{in,fictitious}$ is predefined. In step 146, proceeding therefrom and using the equations of system model 100' (which are identical to the equations of system model 100), the fictitious value $\overline{\theta}_{set,fictitious}$ for the average oxygen fill level of the catalytic converter is calculated. In step 148, the difference between the fictitious average fill level $\overline{\theta}_{set,fictitious}$ and the filtered fill level setpoint $\overline{\theta}_{set,flt}$, or the unfiltered fill level setpoint $\overline{\theta}_{set}$, is calculated, and is compared with a predefinable threshold value. If the difference is greater than the threshold value, then in step 150 an iterative modification of the fictitious lambda value $\lambda_{in,fictitious}$, and a branching of execution to before step 146, occur. The loop made up of steps 146, 148, and 150 is cycled through repeatedly as applicable, a modification of the fictitious lambda value $\lambda_{in,fictitious}$ occurring in step 150 with each pass. When the result of step 150 is that the difference between the fictitious average fill level $\overline{\theta}_{set,fictitious}$ and the filtered fill level setpoint $\overline{\theta}_{set,flt}$ is less than the threshold value, no further modification of the fictitious lambda value $\lambda_{in,fictitious}$ occurs in that execution cycle of the sub-program, and the sub-program branches to step 152, in which the fictitious lambda value $\lambda_{in,fictitious}$ ascertained up to that point is used as a baseline lambda setpoint BLS.

Figure 6:
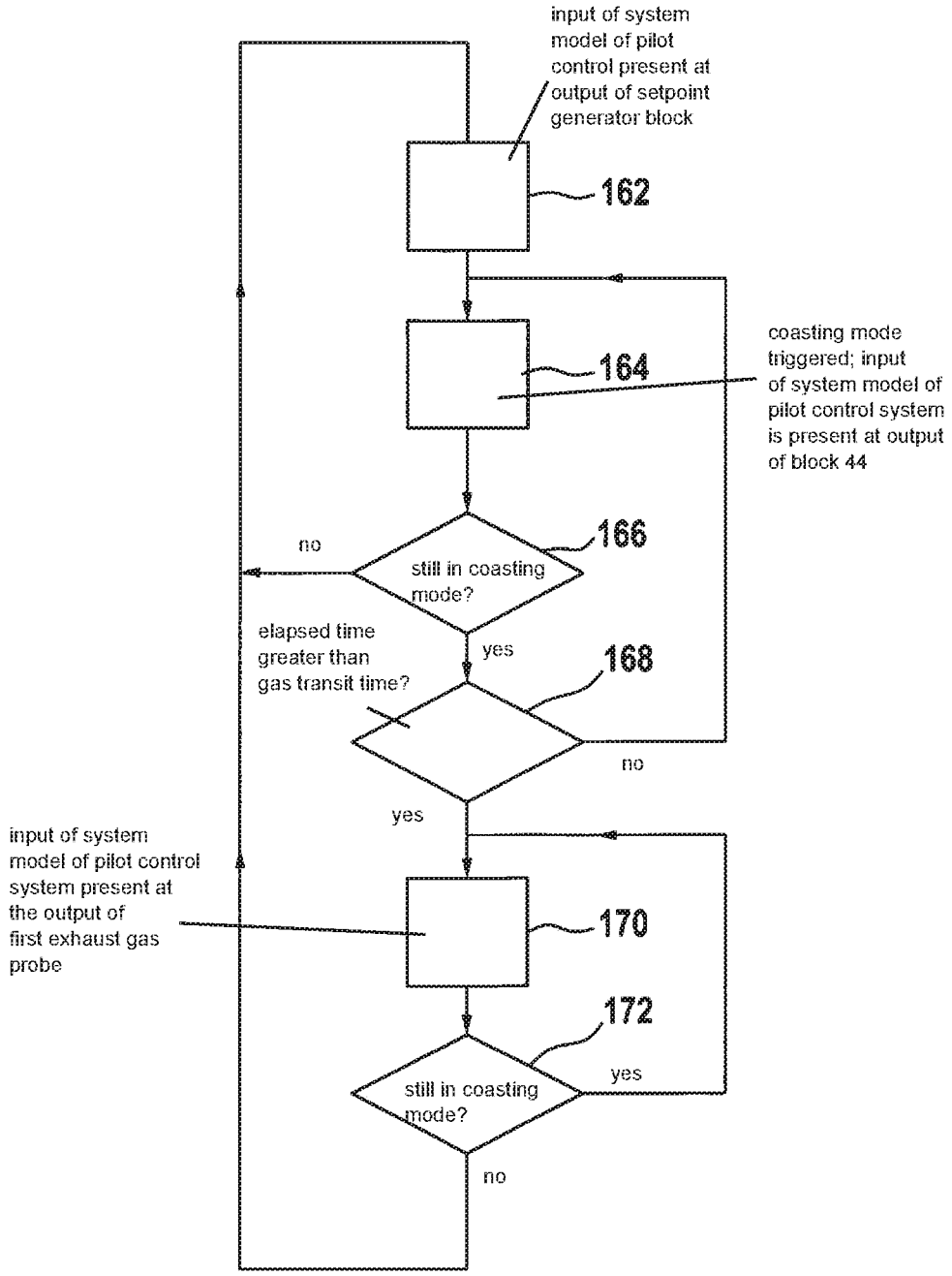
FIG. 6 is a flow chart constituting an exemplifying embodiment of a second part of a method according to the present invention.

FIG. 6 shows a flow chart constituting an exemplifying embodiment of a method for executing the pilot control function explained with reference to FIGS. 4A-4D, as executed during a coasting mode. The flow chart is preferably executed as a sub-program of engine control program 16.1 of FIG. 1.

In step 162, the input of system model 100' of pilot control system 136 is present at the output of setpoint generator block 32'. This corresponds to an execution of a main program for controlling the internal combustion engine. When a coasting mode is then triggered, the program branches to step 164, in which the input of system model 100' of pilot control system 136 is present at the output of block 44.

Step 166 checks whether the internal combustion engine is still in coasting mode. If that is not the case, the program then branches back to step 162, in which the input of system model 100' of pilot control system 136 is present at the output of setpoint generator block 32'. If the internal combustion engine is still in coasting mode, however, the program branches to step 168, which checks whether the time elapsed since the transition into coasting mode with fuel shutoff is longer than the gas transit time. If that is not the case, the program continues with step 164, so that the input of system model 100' of pilot control system 136 continues to be present at the output of block 44. If the time since the transition into coasting mode with fuel shutoff is longer than the gas transit time, however, the input of system model 100' is then applied, in step 170, to the output of exhaust gas probe 32. Step 172 that follows checks, like step 166, whether the internal combustion engine is still in coasting mode. If that is the case, the program then branches back to step 170, in which the input of system model 100' of pilot control system 136 is present at the output of first exhaust gas probe 32. If the internal combustion engine is no longer in coasting mode, however, the program branches to step 162, in which the input of system model 100' of pilot control system 136 is again present at the output of setpoint generator block 32'.

What is claimed is:

1. A method for regulating a filling of an exhaust gas component reservoir of a catalytic converter in the exhaust of an internal combustion engine, comprising:

ascertaining an actual fill level of the exhaust gas component reservoir using a first system model to which signals of a first exhaust gas probe, which projects into the exhaust gas flow upstream from the catalytic converter and detects a concentration of the exhaust gas constituent, are delivered; and predicting a change in the actual fill level in a coasting phase of the internal combustion engine, as a function of at least one of the following variables: raw emissions of at least one exhaust gas constituent, exhaust gas mass flow, exhaust gas temperature, catalytic converter temperature, wherein, values of the variables in the coasting phase are predicted from signals of sensors and control variables of the internal combustion engine which relate to the delivery of air and/or fuel to combustion chambers of the internal combustion engine, wherein the prediction of the change in the actual fill level, as the function of the signals of the sensors and the control variables, starts at a beginning of a coasting phase of the internal combustion engine, in which no fuel is metered to the combustion chambers, and is made for a length of time up to a gas transit time span required by the exhaust gas to reach the first exhaust gas probe, and upon the coasting phase continuing longer than the gas transmit time, the prediction of the change in the actual fill level, as the function of the signals of the sensors and the control variables, is aborted.

2. The method as recited in claim 1, wherein:

a calculation of the actual fill level which occurs as a function of the signals of the sensors and the control variables occurs for a length of the coasting phase if the coasting phase is shorter than the gas transit time.

3. The method as recited in claim 1, wherein:

the actual fill level of the exhaust gas component reservoir is ascertained using the first system model to which the signals of the first exhaust gas probe, which projects into the exhaust gas flow upstream from the catalytic converter and detects the concentration of the exhaust gas constituent, are delivered, and in which a baseline lambda setpoint for a first control loop in an operating mode occurring with fuel metering to combustion chambers of the internal combustion engine is predefined by a second control loop;

the baseline lambda setpoint is converted, by a second system model identical to the first system model (100), into a fictitious fill level;

the fictitious fill level is compared with a setpoint, outputted by a setpoint generator, for the fill level;

the baseline lambda setpoint is iteratively modified as a function of a comparison result if the comparison result produces a difference between the setpoint for the fill level and the fictitious fill level which is greater than a predefined magnitude;

the baseline lambda setpoint is not modified if the comparison result does not produce a difference between the setpoint for the fill level and the fictitious fill level which is greater than the predefined magnitude; and the baseline lambda setpoint is calculated, at the beginning of a coasting phase of the internal combustion engine in which no fuel metering into the combustion chambers is occurring, as a function of the signals of the sensors and the control variables of the internal combustion engine which relate to the delivery of air and/or fuel to combustion chambers of the internal combustion engine.

4. The method as recited in claim 3, wherein:

a check is made as to whether the internal combustion engine is still in the coasting phase;

if the internal combustion engine is not still in the coasting phase, a calculation of baseline lambda setpoints occurs by defining baseline lambda setpoints for a fueled mode; and if the internal combustion engine is still in the coasting phase, a check is made as to whether a time elapsed since a transition into the coasting phase with fuel shutoff is longer than the gas transit time.

5. The method as recited in claim 4, wherein when the time elapsed since the transition into the coasting phase with fuel shutoff is longer than the gas transit time, signals of the first exhaust gas probe are used as baseline lambda setpoints.

6. The method as recited in claim 5, wherein:

a check is made as to whether the internal combustion engine is still in the coasting phase; and if the internal combustion engine is not still in the coasting phase, a calculation of baseline lambda setpoints occurs by defining baseline lambda setpoints for a fueled mode.

7. The method as recited in claim 3, wherein:

a deviation of the actual fill level from a predetermined fill level setpoint is ascertained and is processed by a fill level regulation system to yield a lambda setpoint correction value;

a sum of the baseline lambda setpoint and the lambda setpoint correction value is calculated; and the sum is used to calculate a correction value with which a metering of fuel to at least one combustion chamber of the internal combustion engine is influenced.

8. The method as recited in claim 3, wherein:

the exhaust gas component is oxygen;

in the first control loop, a lambda regulation operation occurs in which the signal of the first exhaust gas probe (32) is processed as an actual lambda value;

the lambda setpoint is calculated in the second control loop; and a fill level system deviation, constituting a deviation of the fill level modeled with the first catalytic converter model from the filtered fill level setpoint, is calculated;

the fill level system deviation is delivered to a fill level regulation algorithm that calculates therefrom a lambda setpoint correction value; and the lambda setpoint correction value is added to the baseline lambda setpoint to provide a sum; and the sum constitutes the lambda setpoint.

9. The method as recited in claim 8, wherein the catalytic converter model has an output lambda model that is configured to convert concentrations, calculated using the first catalytic converter model, of individual exhaust gas components into a signal that is comparable with a signal of a second exhaust gas probe that is disposed downstream from the catalytic converter and is exposed to the exhaust gas.

10. The method as recited in claim 1, wherein the sensors used to predict the values of the variables include an air mass sensor measuring the air delivered to the combustion chambers of the internal combustion engine.

11. The method as recited in claim 1, wherein the sensors used to predict the values of the variables include a rotation angle sensor measuring a rotation angle of a shaft of the internal combustion engine.

12. A control unit configured to regulate a filling of an exhaust gas component reservoir of a catalytic converter in the exhaust of an internal combustion engine, the control unit configured to:

ascertain an actual fill level of the exhaust gas component reservoir using a first system model to which signals of a first exhaust gas probe, which projects into the exhaust gas flow upstream from the catalytic converter and detects a concentration of the exhaust gas constituent, are delivered; and predict a change in the actual fill level in a coasting phase of the internal combustion engine, as a function of at least one of the following variables: raw emissions of at least one exhaust gas constituent, exhaust gas mass flow, exhaust gas temperature, catalytic converter temperature, the control unit being configured to predict values of the variables in the coasting phase from signals of sensors and control variables of the internal combustion engine which relate to the delivery of air and/or fuel to combustion chambers of the internal combustion engine, wherein the prediction of the change in the actual fill level, as the function of the signals of the sensors and the control variables, starts at a beginning of a coasting phase of the internal combustion engine, in which no fuel is metered to the combustion chambers, and is made for a length of time up to a gas transit time span required by the exhaust gas to reach the first exhaust gas probe, and upon the coasting phase continuing longer than the gas transmit time, the prediction of the change in the actual fill level, as the function of the signals of the sensors and the control variables, is aborted.

13. The control unit as recited in claim 12, wherein:

a calculation of the actual fill level which occurs as a function of the signals of the sensors and the control variables occurs for a length of the coasting phase if the coasting phase is shorter than the gas transit time.

* * * * *